United States Patent [19]

Mallory et al.

[11] Patent Number: 4,582,668

[45] Date of Patent: Apr. 15, 1986

[54] WASTE CONTAINER CLOSURE MECHANISM

[75] Inventors: Charles W. Mallory, Severna Park; Charles T. Nentwig, Columbia; Harold L. Newhouse, Gaithersburg, all of Md.

[73] Assignee: Westinghouse Electric Corp., Pittsburgh, Pa.

[21] Appl. No.: 514,230

[22] Filed: Jul. 15, 1983

[51] Int. Cl.[4] ..... G21F 5/00

[52] U.S. Cl. ..... 376/203; 376/272; 220/90.4; 220/253; 220/254; 220/256

[58] Field of Search ..... 250/505.1, 506.1, 515.1; 376/203, 260, 261, 262, 272; 220/90.4, 253, 254, 256

[56] References Cited

U.S. PATENT DOCUMENTS

| | | | |
|---|---|---|---|
| 2,962,185 | 11/1960 | Starr et al. | 220/254 |
| 3,086,679 | 4/1963 | Bijvoet | 220/254 |
| 3,255,912 | 6/1966 | Schmid | 220/256 |

*Primary Examiner*—Charles T. Jordan
*Assistant Examiner*—Richard Klein
*Attorney, Agent, or Firm*—Joel R. Petrow

[57] ABSTRACT

Disclosed is a closure mechanism for sealing a nuclear waste disposal container. The mechanism allows partial closure of the container after internal apparatus have been inserted leaving a smaller opening for inserting and processing the waste material. Partial closure is achieved by inserting into the container an annular inner ring that fits against the container and by tightening an annular outer cap onto the inner ring, permitting access to the container through the aligned openings. After the waste material is loaded and processed, a sealing disk, axially joined to an inner plug to permit rotational but not linear movement, is passed through the outer cap opening and seats around the inner ring opening. The inner plug is tightened against the sealing disk by engaging matching threads on the inside of the outer cap opening.

6 Claims, 2 Drawing Figures

WASTE CONTAINER CLOSURE MECHANISM

BACKGROUND OF THE INVENTION

Disposal of low-level nuclear wastes require that the waste be placed in a container suitable for burial. If the ultimate disposal site is not located at the generation point of such wastes, further container requirements are imposed to meet normal and accident transportation conditions.

One method of meeting these dual requirements is to design a single container capable of achieving the criteria established for both transport and burial. The stringent transportation requirements, however, dictate the use of a sturdy and expensive steel shell that would serve its purpose only once before being buried.

A more practical method of meeting the short term transportation and long term burial needs for nuclear waste disposal is to utilize separate burial containers and transportation casks. A container adequate for burial at the disposal site is placed within the transportation cask during handling and shipping, then is removed for burial at the disposal site, freeing the cask for reuse.

This burial container, sometimes referred to as a liner, must have an opening large enough to accommodate any apparatus that has to be inserted into the liner to process the waste, such as removing water from the slurry before shipment, as well as allowing human access for positioning of this apparatus. For this reason the prior art typically used a closure system with a plug or cap covering an opening in one end of a generally cylindrical burial container that was as large as the end of the container itself. Because metal containers will not typically withstand the environment of long-term burial, increasing use has been made of plastics. Burial containers, or liners, are often made of a high density plastic which is rotationally molded into the desired shape. Because it is undesirable to have joints in this material, elements of a closure system must be capable of being fabricated in one piece by the rotational molding process. In order to avoid tearing any type of seal or gasket in a container employing a screw type closure, a seal or gasket was first placed around the perimeter of the opening of the container. A stationary member was placed over the gasket then a screw type cap would bear down upon the stationary member and thereby seal the container.

It would be preferred, however, to have a smaller opening in which to add the waste or waste slurry. Having the open end of the container partially closed stabilizes any internal apparatus and lessens the likelihood of accidental spillage.

SUMMARY OF THE INVENTON

There is provided a closure mechanism for sealing a waste disposal container that allows a portion of the opening to be first sealed, reducing the size of the opening to the container, then after all wastes have been added and processed, the remainder of the opening is sealed. The opening is first reduced in size by placing an inner ring with a gasket into the waste container. The interior diameter of the inner ring defines the now reduced opening. An annular outer cap is then rotated onto threads on the exterior of the container bearing down upon the inner ring and sealing the gasket. After the desired quantity of contents is added to the container through concentric openings in the outer cap and inner ring, a sealing disk also containing a second gasket is passed through the outer cap and placed on the inner ring. After the desired quantity of material is added to the container and processing is complete, a sealing disk containing a third gasket is passed through the outer cap and seated on the inner ring. Threads in the interior of the outer cap form the means by which an inner plug is rotated down onto the sealing disk forming a hermetic boundary between the sealing disk gasket and inner ring.

BRIEF DESCRIPTION OF THE DRAWINGS

For a better understanding of the invention, reference may be had to the preferred embodiment shown in the accompanying drawings, in which.

DESCRIPTION OF THE PREFERRED EMBODIMENTS

Figure 1:
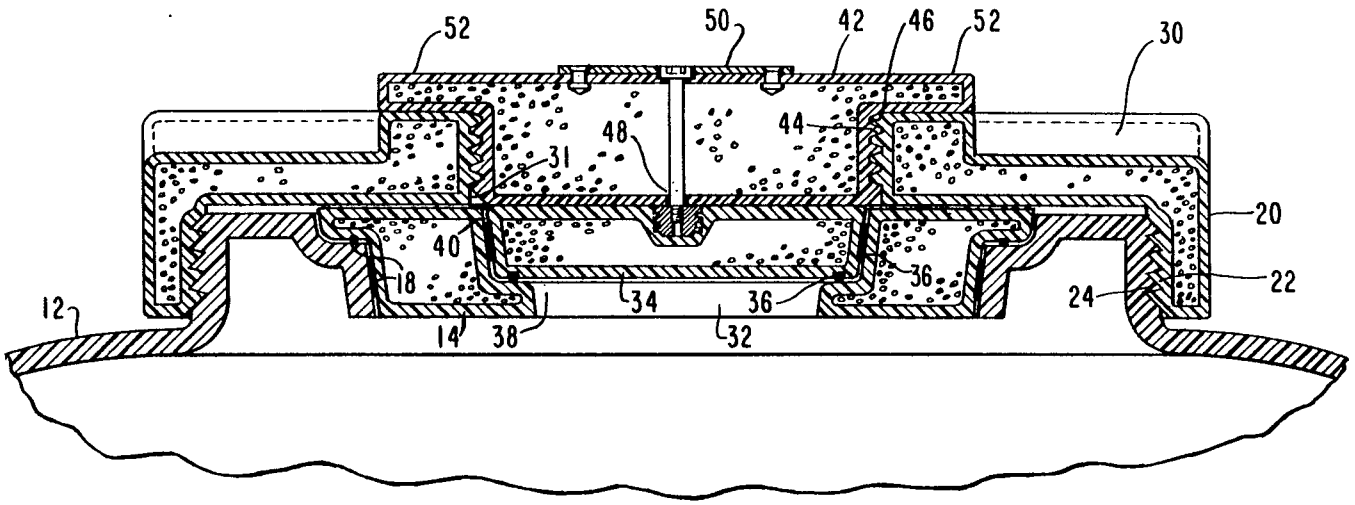
FIG. 1 is a cross-sectional view showing the uppermost portion of the waste disposal container and in section all of the elements of the invention.

Reference now in detail to the drawings wherein like reference characters represent like parts throughout the several views, there is illustrated in FIG. 1 a cross-sectional view of the closure mechanism. The waste disposal container 12 is designed to accommodate the type of waste to be buried along with any associated apparatus required to process the waste once inside the waste disposal container. For example a mechanism for removal of excess water from a waste slurry is often inserted into the waste disposal container 12 before adding any waste material.

After the appropriate appurtenances are placed within the waste disposal container 12, an inner ring 14 is inserted into the container. The outer perimeter of the inner ring contains a first sealing means such as gaskets 18 which are placed adjacent the container surface, forming a continuous boundary between the container 12 and the outer perimeter surface of the inner ring.

An outer cap 20 is then placed onto the container 12 such that the threads 22 on the inside of the outer cap perimeter of the outer cap engage matching container threads 24 on the outside of the outer perimeter of the container. The outer cap 20 brings force to bear upon the inner ring 14 as the outer cap threads and container threads increasingly engage so that a hermetic seal is formed between the container 12 and inner ring 14 by the first sealing means such as gasket 18. Tool receiving means such as indentations 30 may be provided for assisting in the rotation of the outer cap in engaging the matching threads.

With the inner ring and outer cap in place on the waste diposal container, the container is ready for filling with waste either within the transportation cask or standing alone. Waste is added through outer cap opening 31 and the inner ring opening 32, smaller in diameter than the diameter of the outer cap opening 31, these openings also permitting the addition and removal of products during in-container processing after the waste material has been added.

When processing of the waste material is completed and the container is to be readied for transport, the opening in the inner ring and outer cap is closed. This is done by placing a sealing disk 34 adjacent the interior annular surface of the inner ring. The diameter of the sealing disk 34 is larger than the diameter of the inner ring opening 32, but smaller than the diameter of the outer cap opening 31. The sealing disk comprises a second sealing means such as gaskets 36 which are placed adjacent the inner ring and forms a continuous boundary between the sealing disk 34 and the interior annular surface of the inner ring.

The inner ring opening 32 may comprise a first portion 38 which is of a diameter smaller than the diameter of the sealing disk extending from the bottom of the inner ring and partially through the inner ring, and a second portion 40 which has a slightly larger diameter than the diameter of the sealing disk extending the remainder of the way to the top of the inner ring. This provides an indentation for the sealing disk to rest giving better contact between the inner ring and second sealing means.

An inner plug 42 having threads 44 around the outer surface that match outer cap opening threads 46 on the inner surface of the outer cap is inserted into the outer cap opening 31 by engaging the matching threads 44 and 46. As the threads are increasingly engaged the inner plug 42 brings force to bear upon the sealing disk 34 which causes the second sealing means to form a hermetic seal between the inner ring and the sealing disk. The waste disposal container is now entirely sealed and the contents of the container are isolated from the environment.

It is further possible to employ a joining means 48 that connect the sealing disk and inner plug along their cylindrical axis so as to allow limited motion between the sealing disk and inner plug linearly along the cylindrical axis while permitting free relative rotation around their common cylindrical axis. Use of this joining means allows for ease of insertion and handling of the now combined elements without impairing their functions.

Figure 2:
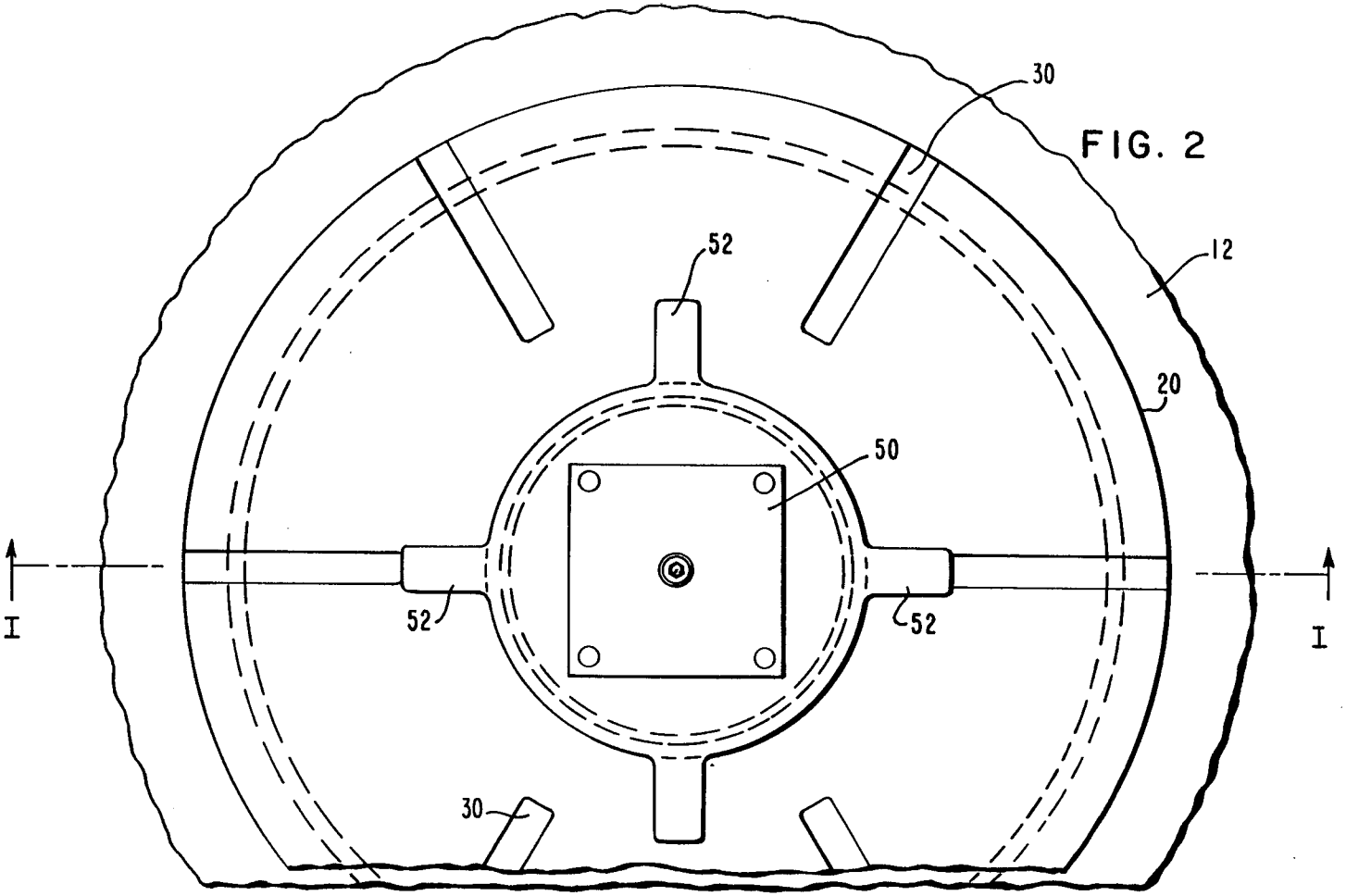
FIG. 2 is a top view of a waste disposal container employing the disclosed invention in the fully assembled state.

Referring now to FIG. 2, the inner plug 42 may also incorporate a magnetically attractive material positioning means such as steel plate 50 which permits remote handling and positioning of the inner plug. This capability is of extreme importance after the container has been filled with waste material.

Turning means such as protrusions 52 may be provided to assist the manual or mechanical turning of the inner plug to engage the matching threads and apply force to the sealing disk.

We claim:

1. A waste disposal container closure mechanism comprising:

an inner ring having an opening centered approximate the cylindrical axis of said cylindrical inner ring;

a first sealing means attached to said inner ring such that said first sealing means forms a continuous boundary with the waste disposal container when said inner ring is placed within the opening of the waste disposal container with said first sealing means adjacent the waste disposal container;

an annular outer cap having threads that engage matching threads of the waste disposal container, said outer cap exerting force upon said inner ring as said outer cap increasingly engages the threads on the waste disposal container, said outer cap having a threaded opening approximate the cylindrical axis that is larger in diameter than the opening of said inner ring;

a sealing disk larger in diameter than the diameter of the opening of said inner ring but smaller in diameter than the diameter of the threaded opening of said outer cap, said sealing disk having a second sealing means that forms a continuous boundary with said inner ring when said second sealing means is placed adjacent said inner ring; and an inner plug having threads on the outside that match and engage the threads within the opening of said outer cap such that the plug exerts force upon said sealing disk as said inner plug increasingly engages the threads on said outer cap inner member.

2. The closure mechanism of claim 1 wherein said inner ring has an opening comprising:

a first portion that begins on the bottom of said inner ring and extends partially through said inner ring, said first portion of a diameter smaller than said sealing disk; and a second portion that extends the remainder of the distance through said inner ring to the top of said inner ring, said second potion of a size larger than said sealing disk, such that said second sealing means of said sealing disk forms a continuous boundary with the first portion of said opening when said second sealing means is placed adjacent the interface of the first and second portions of said opening.

3. The closure mechanism of claim 1 wherein said inner plug comprises a member made of a magnetically attractive material for remote positioning of said inner plug.

4. The closure mechanism of claim 1 wherein said outer cap comprises tool receiving means for rotation of said outer cap.

5. The closure mechanism of claim 1 wherein said sealing disk and said inner plug comprise a joining means at their cylindrical axes allowing free relative rotational movement and little relative axial linear movement between said plug and said disk.

6. The closure mechanism of claim 1 wherein said inner plug comprises turning means for rotation of said inner plug.

* * * * *